US007562651B2

(12) United States Patent
Xia et al.

(10) Patent No.: US 7,562,651 B2
(45) Date of Patent: Jul. 21, 2009

(54) VAPOR CANISTER HAVING INTEGRATED EVAPORATIVE EMISSION PURGE ACTUATION MONITORING SYSTEM HAVING FRESH AIR FILTER

(75) Inventors: Zhouxuan Xia, Windsor (CA); Kevin Mulkeran, Holly, MI (US)

(73) Assignee: MAHLE Technology, Inc., Farmington Hills, MI (US)

( * ) Notice: Subject to any disclaimer, the term of this patent is extended or adjusted under 35 U.S.C. 154(b) by 59 days.

(21) Appl. No.: 11/986,061

(22) Filed: Nov. 19, 2007

(65) Prior Publication Data

US 2009/0126702 A1 May 21, 2009

(51) Int. Cl.
*F02M 33/02* (2006.01)
*F02M 33/04* (2006.01)

(52) U.S. Cl. ..... 123/518; 123/519

(58) Field of Classification Search ..... 123/518, 123/519, 520, 516, 198 D, 521; 137/587, 137/588; 417/34, 35, 46, 28, 395
See application file for complete search history.

(56) References Cited

U.S. PATENT DOCUMENTS 4,703,737 A 11/1987 Cook et al. ..... 123/520
5,383,437 A * 1/1995 Cook et al. ..... 123/520
5,474,050 A 12/1995 Cook et al. ..... 123/520
5,499,614 A * 3/1996 Busato et al. ..... 123/520
6,073,487 A 6/2000 Dawson ..... 73/118.1
6,253,598 B1 7/2001 Weldon et al. ..... 73/40
6,282,945 B1 * 9/2001 Weldon et al. ..... 73/40
6,378,510 B1 4/2002 Green et al. ..... 123/568.27
6,823,850 B1 11/2004 Hurley ..... 123/518
7,047,950 B2 5/2006 Hurley ..... 123/516
7,216,636 B2 5/2007 Hurley ..... 123/519
7,431,022 B1 * 10/2008 Xia et al. ..... 123/520

* cited by examiner

*Primary Examiner*—Mahmoud Gimie
(74) *Attorney, Agent, or Firm*—Bliss McGlynn, P.C.

(57) ABSTRACT

A vapor canister having an integrated evaporative emission canister purge actuation monitoring system. The vapor canister has a plurality of sidewalls defining a housing with a valve body formed integrally on the housing and a cover mounted to the valve body so as to define a vent chamber between the cover and the valve body. The integrated valve body has a main flow passage and a canister port. An air filter assembly is disposed adjacent to the valve body on the housing and provides fluid communication between the main flow passage and the ambient air. A first one-way umbrella valve mounted to the valve body that is responsive to predetermined positive pressure in the main flow passage to control flow of fluid from a vapor canister to ambient air as well as a second one-way umbrella valve that is responsive to a predetermined negative pressure in the main flow passage to control the flow of ambient air through an air filter assembly.

12 Claims, 7 Drawing Sheets

VAPOR CANISTER HAVING INTEGRATED EVAPORATIVE EMISSION PURGE ACTUATION MONITORING SYSTEM HAVING FRESH AIR FILTER

BACKGROUND OF THE INVENTION

1. Field of the Invention

The present invention is directed toward a vapor canister, and more specifically to a vapor canister having an integrated evaporative emission purge actuation monitoring system for a motor vehicle having an engine, and at least one control unit.

2. Description of the Related Art

Automotive vehicles include fuel delivery systems having a fuel tank and fuel delivery lines. The fuel delivery lines typically include a plurality of conduits and associated connections operatively interconnecting the fuel tank with an internal combustion engine. A fuel pump is used to deliver the fuel under pressure from the tank to the engine via the fuel delivery lines. Many automotive vehicles are powered using gasoline as fuel. Gasoline is a volatile substance that generates gasses that, if untreated, are harmful to the environment. These gasses are generally referred to as evaporative emissions. Because they are gasses, these emissions can escape from the fuel system even through very small orifices that may present themselves throughout the fuel delivery system. Accordingly, various governmental authorities in countries throughout the world have long mandated that automotive vehicles include systems for preventing the release into the atmosphere of untreated or un-combusted fuel vapor generated in the fuel delivery system.

Thus, gasoline powered automotive vehicles typically include evaporative emission control systems that are designed to effectively deal with the evaporative emissions. Such systems typically include a vapor canister operatively connected in fluid communication with the fuel tank and the intake of the internal combustion engine. The vapor canister typically includes carbon or some other absorbent material that acts to trap the volatile evaporative emissions generated by the fuel system. A canister purge valve controls the flow of evaporative emissions between the canister and the intake of the engine. In turn, the operation of the canister purge valve is typically controlled by an onboard computer, such as the engine control module, or the like. During normal vehicle operation, and subject to predetermined operational characteristics, the canister purge valve is opened to subject the vapor canister to the negative pressure of the engine intake manifold. This purges the vapor canister of trapped gaseous emissions, effectively regenerating the canister so that it may absorb additional vapor.

During vehicle shutdown, the canister purge valve is closed and the evaporative emissions generated in the fuel system are routed from the fuel tank to the vapor canister where they are absorbed and stored for later purging as described above. During vehicle shutdown, the fuel system is effectively sealed from the ambient environment. An air filter is typically connected in fluid communication with the vapor canister via associated plumbing to provide a source of fresh air and to further filter the air that is stripped of hydrocarbons after it has passed through the canister. A separate valve may be employed to control the flow of fluid between the air filter and the vapor canister.

While the evaporative emission systems of the type proposed in the related art have generally worked for their intended purposes they have also suffered from the disadvantage of being relatively complex and costly. They also generally consist of a number of components which must be separately controlled and interconnected via flexible or hard conduits sometimes referred to as "on-board plumbing". In many of the systems presently employed in the related art, each component often requires its own mounting strategy and associated fasteners. The on-board plumbing must be routed so as not to clutter the engine. This objective is not always met in evaporative emission systems known in the related art and they can be expensive to service. Further, and because of the ever-shrinking space available for the vehicle power plant, the effective use of space through efficient component packing is a parameter which designers must constantly seek to improve.

Thus, there remains a need in the art for an evaporative emission system which reduces the number of components needed to effectively monitor the system. Further, there is a need for such a system that reduces the complicated on-board plumbing of the type required for systems known in the related art. There is also a need in the art for an evaporative emission canister purge actuation monitoring system that is inexpensive to manufacture and easy to service in the field. Finally, there is a need in the art for an evaporative emission canister purge actuation monitoring system that has improved response time and accurate repeatability and that is smaller than present systems employed in the related art.

SUMMARY OF THE INVENTION

The present invention overcomes the deficiencies in the related art in a vapor canister having an integrated evaporative emission canister purge actuation monitoring system for a motor vehicle having an engine and at least one control unit. The vapor canister includes a plurality of sidewalls defining a housing for the vapor canister. A valve body is formed integrally on the housing of the vapor canister and a cover is mounted to the valve body so as to define a vent chamber between the cover and the valve body. The integrated valve body has a main flow passage and a canister port adapted to establish fluid communication between the vapor canister and the main flow passage. An air filter assembly is disposed adjacent the valve body on the housing and provides fluid communication between the main flow passage and the ambient air. A first one-way umbrella valve is mounted to the integrated valve body and is responsive to a predetermined positive pressure in the main flow passage to control the flow of fluid from the vapor canister to the ambient air, through the vent chamber and to the air filter assembly. In addition, a second one-way umbrella valve is mounted to the integrated valve body and responsive to a predetermined negative pressure in the main flow passage to control the flow of ambient air through the air filter assembly and the vent chamber and through the main flow passage and the second canister port.

In this way, the vapor canister of the present invention reduces the number of components needed to effectively monitor the evaporative emission system as well as the complicated onboard plumbing of the type required for systems known in the related art. The system senses the presence and duration of a purge vacuum that is imposed on the vapor canister when the canister purge valve is open and also senses the presence of a leak in the evaporative emission system, to the extent this condition occurs. The vapor canister having an integrated evaporative emission canister purge actuation monitoring system of the present invention is inexpensive to manufacture and easy to service in the field. Moreover, it has an improved response time and accurate repeatability when compared to known systems in the related art. Finally, the evaporative emission canister purge actuation monitoring system is designed so as to present a smaller, less bulky profile. Accordingly, it is easier to "package" the evaporative emission canister purge actuation monitoring system of the present invention on the vehicle.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
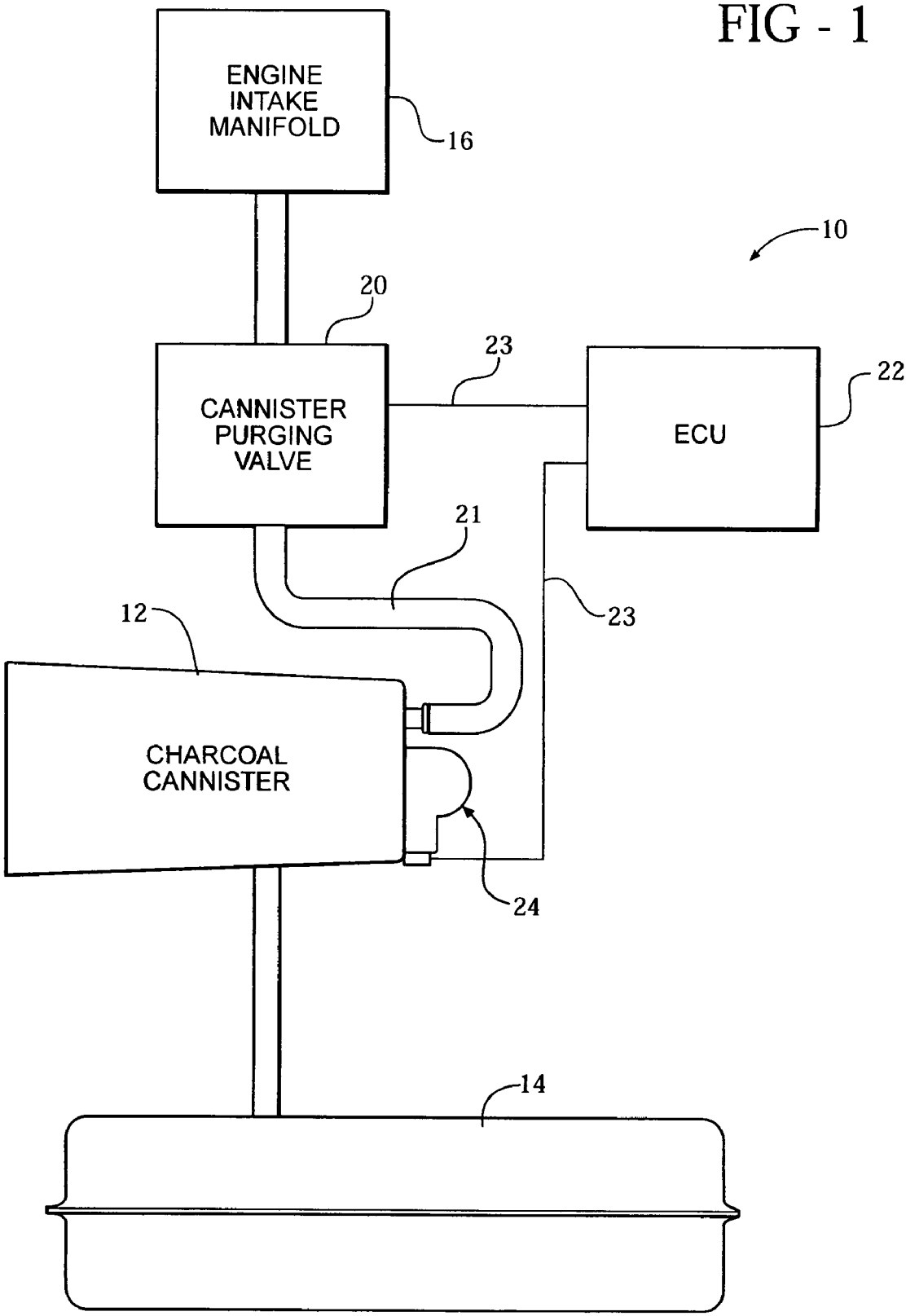
FIG. 1 is a schematic representation of an evaporative emission system of the type employing the vapor canister having an integrated purge actuation monitoring system including an air filter assembly of the present invention.
Figure 2:
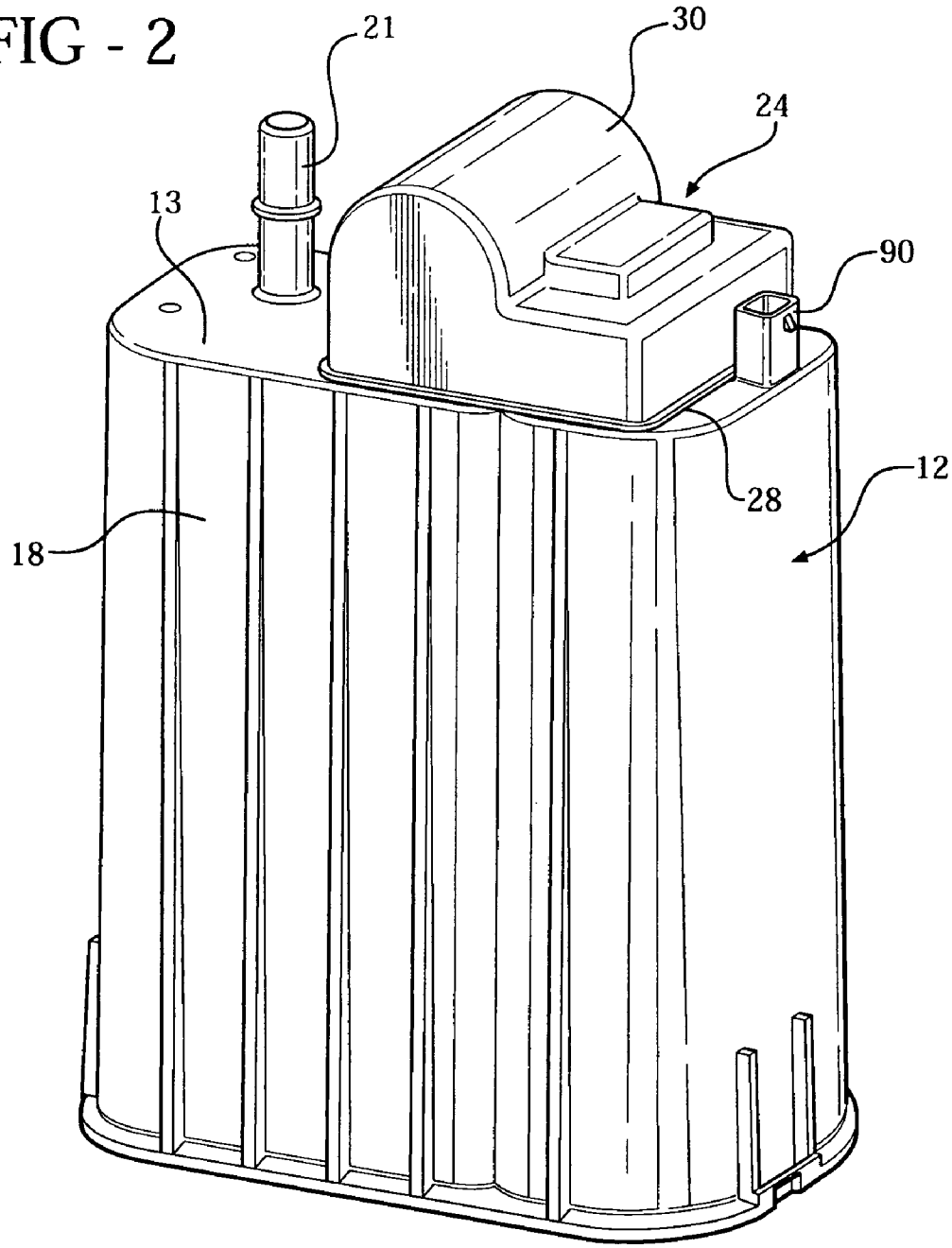
FIG. 2 is a perspective view of one embodiment of the vapor canister having an integrated purge actuation monitoring system including an air filter assembly of the present invention.

Referring now to the drawings, a representative evaporative emission system for an automotive vehicle is schematically illustrated at 10 in FIG. 1. The evaporative emission system 10 generally includes a vapor canister 12 operatively connected in fluid communication with a fuel tank 14 as well as the intake manifold 16 of the internal combustion engine. The vapor canister 12 is typically provided in fluid communication with the ambient air via a fresh air filter which will be described in greater detail below. The vapor canister 12 includes a plurality of sidewalls 13 that generally define a housing 18 (FIG. 2). The housing 18 encloses carbon or some other absorbent material 19 (FIGS. 4 and 5) that acts to trap the volatile evaporative emissions generated by the fuel system. The vapor canister 12 may also include a retention rib 15 (FIGS. 4-5) used to help maintain the absorbent material within the housing 18 defined by the sidewalls 13. However, those having ordinary skill in the art will appreciate from the description that follows that the present invention is not limited to any particular type of vapor canister. With reference to FIG. 1, a canister purge valve, generally indicated at 20, controls the flow of evaporative emissions between the vapor canister 12 and the intake 16 of the engine via a conduit 21 in response to electrical commands sent through an electrical connection schematically indicated at 23. In turn, the operation of the canister purge valve 20 is typically controlled by an onboard computer, such as an engine control module or engine control unit (ECU), or the like, schematically illustrated at 22. An evaporative emission canister purge actuation monitoring system of the present invention is generally indicated at 24, and is formed integrally with the vapor canister 12.

Figure 4:
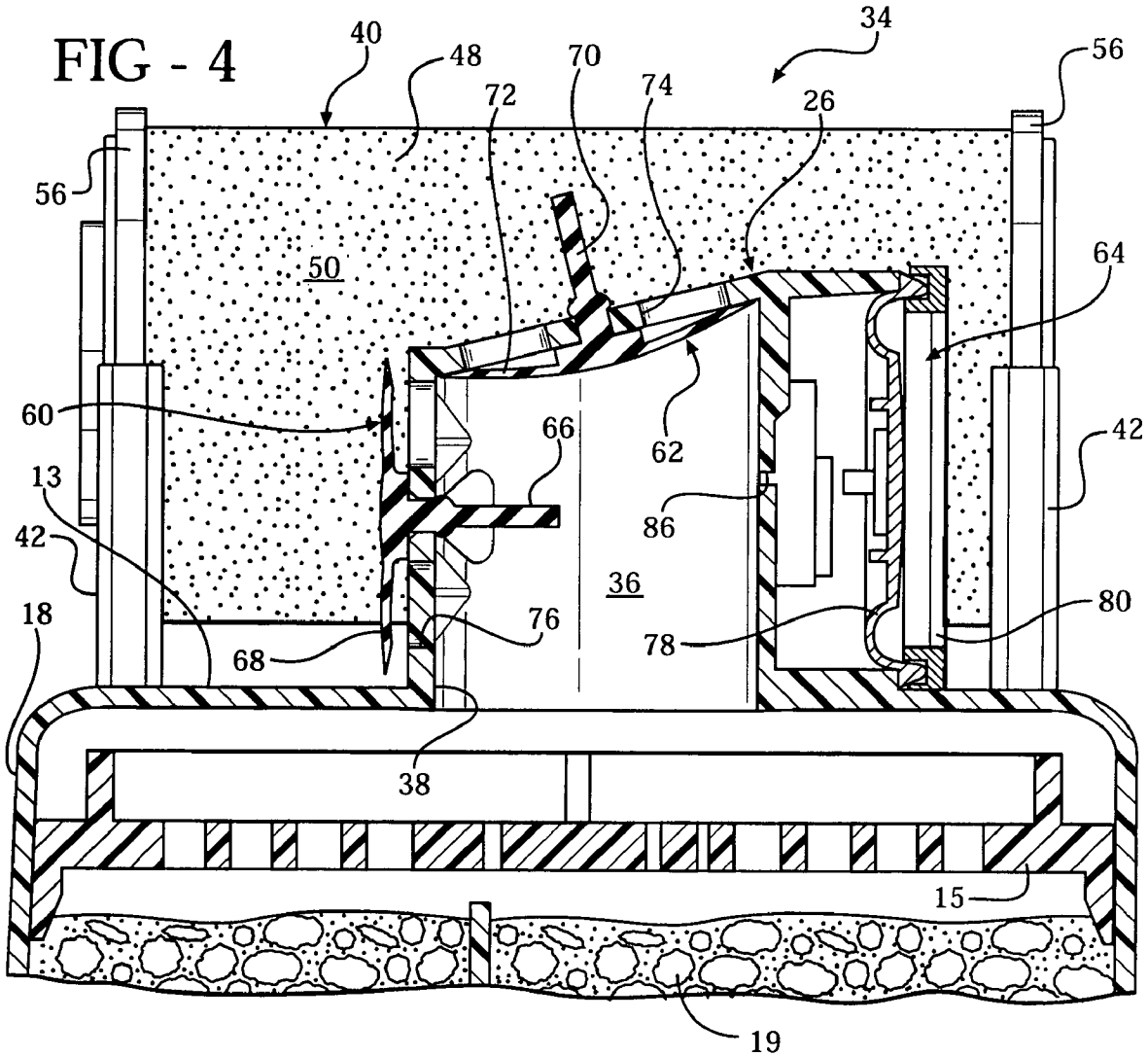
FIG. 4 is a partial cross-sectional side view of one embodiment of the vapor canister having an integrated purge actuation monitoring system including an air filter assembly of the present invention showing the first one-way umbrella valve disposed in the open position.
Figure 5:
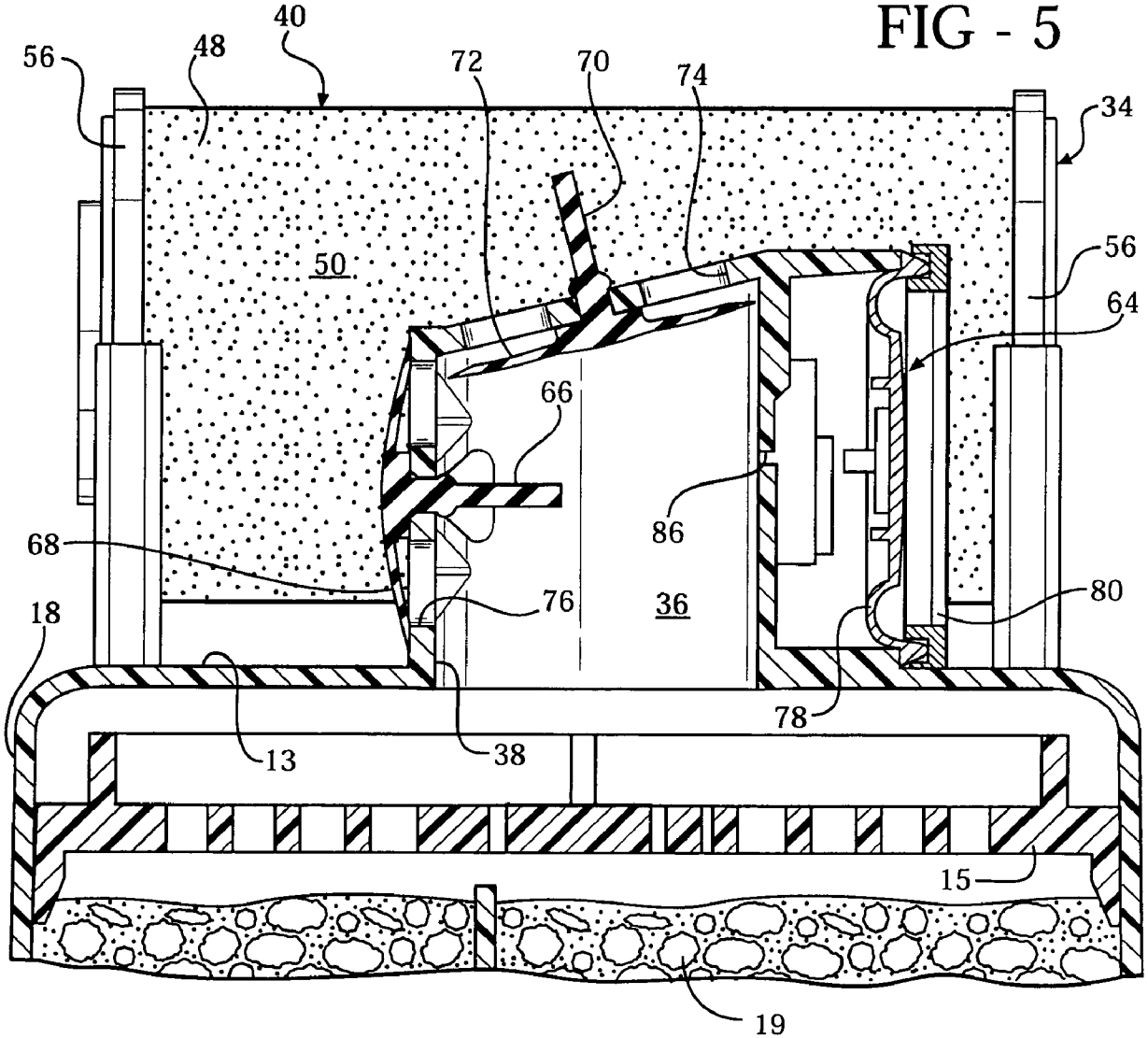
FIG. 5 is a partial cross-sectional side view of one embodiment of the vapor canister having an integrated purge actuation monitoring system including an air filter assembly of the present invention showing the second one-way umbrella valve disposed in the open position.
Figure 6:
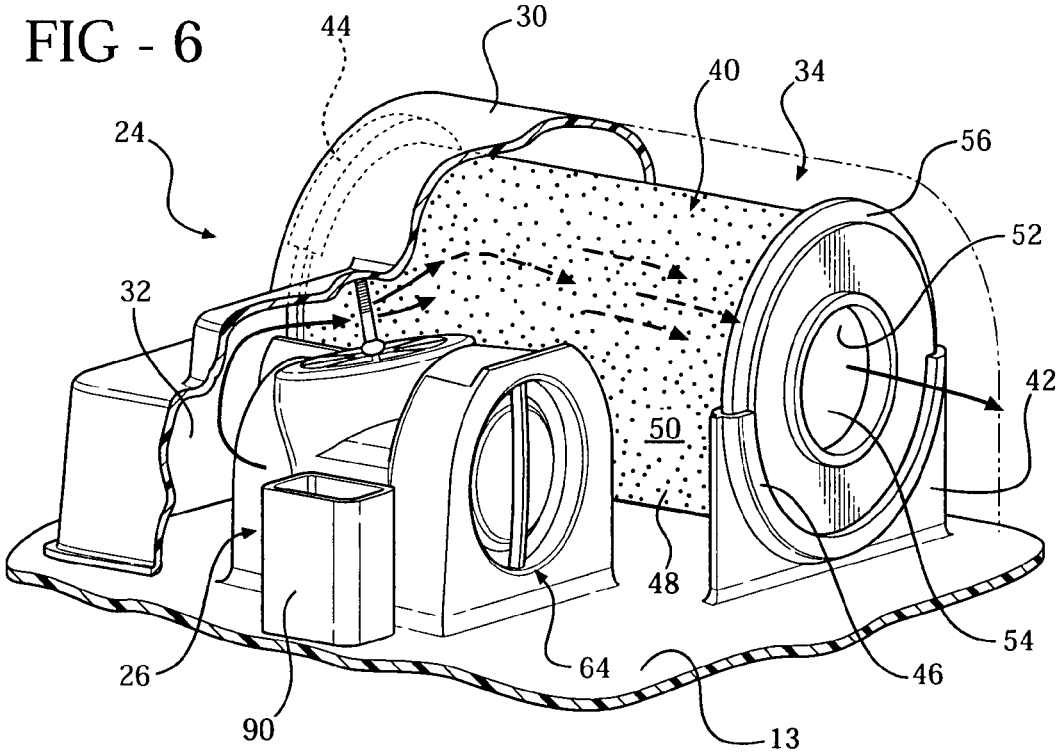
FIG. 6 is a partially broken away perspective view of the integrated purge actuation monitoring system including an air filter assembly illustrating the flow path of air from the valve body through the air filter assembly.
Figure 7:
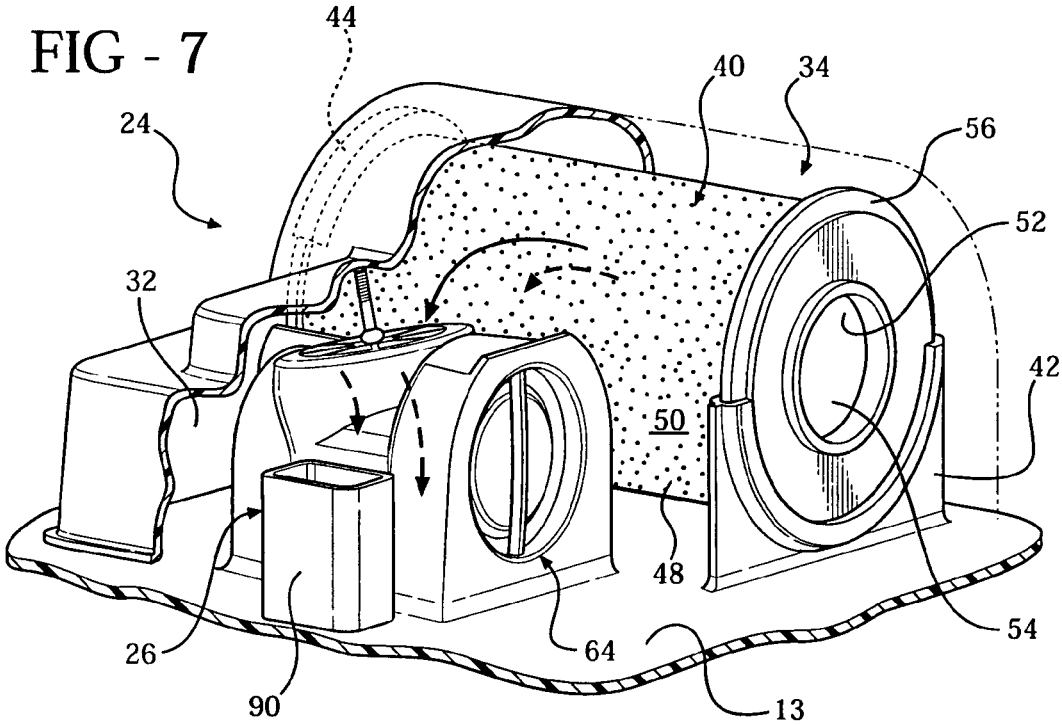
FIG. 7 is a partially broken away perspective view of the integrated purge actuation monitoring system including an air filter assembly illustrating the air flow from the air filter assembly through the valve body and into the vapor canister.

Referring now to FIGS. 2-8, one embodiment of the vapor canister 12 having an integrated evaporative emission canister purge actuation monitoring system for a motor vehicle is generally indicated at 24, where like numerals are used to designate like components throughout the drawings. The system 24 includes an integrated valve body 26 formed on the housing 18 of the vapor canister 12. A cover 30 having a peripheral flange 28 is supported on the housing 18 so as to define a vent chamber 32 between the cover 30 and the valve body 26 (FIGS. 6 and 7). The integrated valve body 26 has a main flow passage 36 and a canister port 38 which is adapted to establish fluid communication between the vapor canister 12 and the main flow passage 36. An integrated fresh air filter assembly is generally indicated at 34 and is disposed adjacent to the valve body 26 on the housing. The fresh air filter assembly 34 provides fluid communication between ambient air and the vent chamber 32 as will be described in greater detail below.

More specifically, the air filter assembly 34 includes a filter cartridge 40 that is operatively supported between the housing 18 of the vapor canister 12 and the cover 30. To this end, the housing and the cover define a pair of opposed retainers 42, 44 that cooperate to mount the air filter cartridge 40 to the housing. These opposed retainers 42, 44 are defined by a pair of semicircular arcs having grooves 46 that face each other. One arc is formed on the canister housing 18. The other is formed on the cover 30. The air filter cartridge 40 includes a cylindrical filter media 48 defining an outer diameter 50 and an inner diameter 52 that presents a hollow passage 54. A pair of flanges 56 are disposed on either end of the air filter cartridge 40. The flanges 56 are received in the grooves 46 defined by the pair of opposed retainers 42, 44 on both the housing and the cover 30. When mounted in its operative position, ambient air may flow past the end flanges 56 through the hollow passage 54 and the filter media 48, past the outer diameter 50 and into the vent chamber 32. In addition, in another operative environment, air may flow from the vent chamber 32 through the outer diameter 50 of the filter media 48, past the inner diameter 52 and into the hollow passage 54 and ultimately to the ambient environment as will be described in greater detail below.

Figure 8:
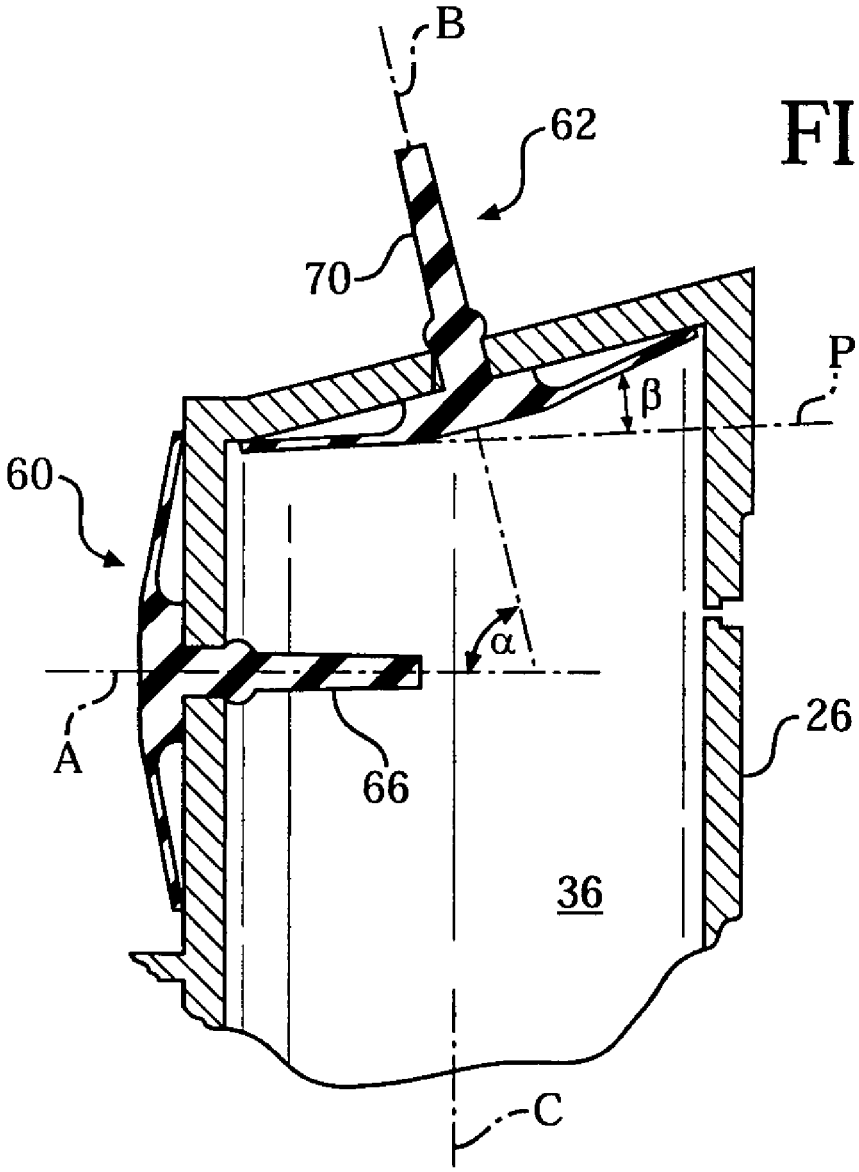
FIG. 8 is an enlarged partial cross-sectional side view of the main flow passage of the integrated valve body of one embodiment of the present invention illustrating the disposition of the first and second valves relative to each other and the main flow passage.

Referring now to FIGS. 4, 5 and 8, a first one-way umbrella valve is generally indicated at 60 and is mounted to the integrated valve body 26. The first one-way umbrella valve 60 is responsive to predetermined pressure in the main flow passage 36 to control the flow of fluid from the vapor canister 12 to the ambient air through the vent chamber 32 and the fresh air filter assembly 34. In addition, a second one-way umbrella valve is generally indicated at 62 and is mounted to the integrated valve body 26. The second one-way umbrella valve 62 is responsive to predetermined negative pressure in the main flow passage 36 to control the flow of ambient air through the fresh air filter assembly 34 and the vent chamber 32 and through the main flow passage 36 and the canister port 38. The system 24 further includes a vacuum actuated switch, generally indicated at 64. The switch 64 is supported by the integrated valve body 26 and is in electrical communication with the control unit 22. The switch 64 is responsive to a predetermined negative pressure in the main flow passage 36 so as to send a vehicle indicative of the predetermined negative pressure to the control unit 22 via the electrical connection schematically indicated at 23 in FIG. 1. Each of these components of the system 24 of the present invention will be described in greater detail below.

The first one-way umbrella valve 60 includes a valve stem 66 and a valve element 68. The valve element 68 is movable to control the flow of fluid, such as air between the main flow passage 36 and the vent chamber 32. The valve stem 66 of the first one-way umbrella valve 60 defines a first longitudinal axis A (FIG. 8). Similarly, the second one-way umbrella valve 62 includes a valve stem 70 and a valve element 72. The valve element 72 is movable to control the flow of fluid, such as air between the vent chamber 32 and the main flow passage 36 (FIG. 5). The valve stem 70 of the second one-way umbrella valve defines a second longitudinal axis B. As best shown in FIG. 8, the first and second longitudinal axes A and B of the first and second one-way umbrella valves 60 and 62 may be disposed at an acute angle a relative to one another.

The main flow passage 36 defines a longitudinal axis C and a canister purge port 74. The second one-way umbrella valve 62 is mounted in the integrated valve body 26 so as to control the flow of fluid through the canister purge port 74. The canister purge port 74 defines an acute angle β relative to a plane P extending perpendicular to the longitudinal axis C of the main flow passage 36 (FIG. 8). The main flow passage 36 also defines a vent port 76. The first one-way umbrella valve 60 is mounted to the integrated valve body 26 so as to control the flow of fluid through the vent port 76 as will be described in greater detail below.

Figure 3:
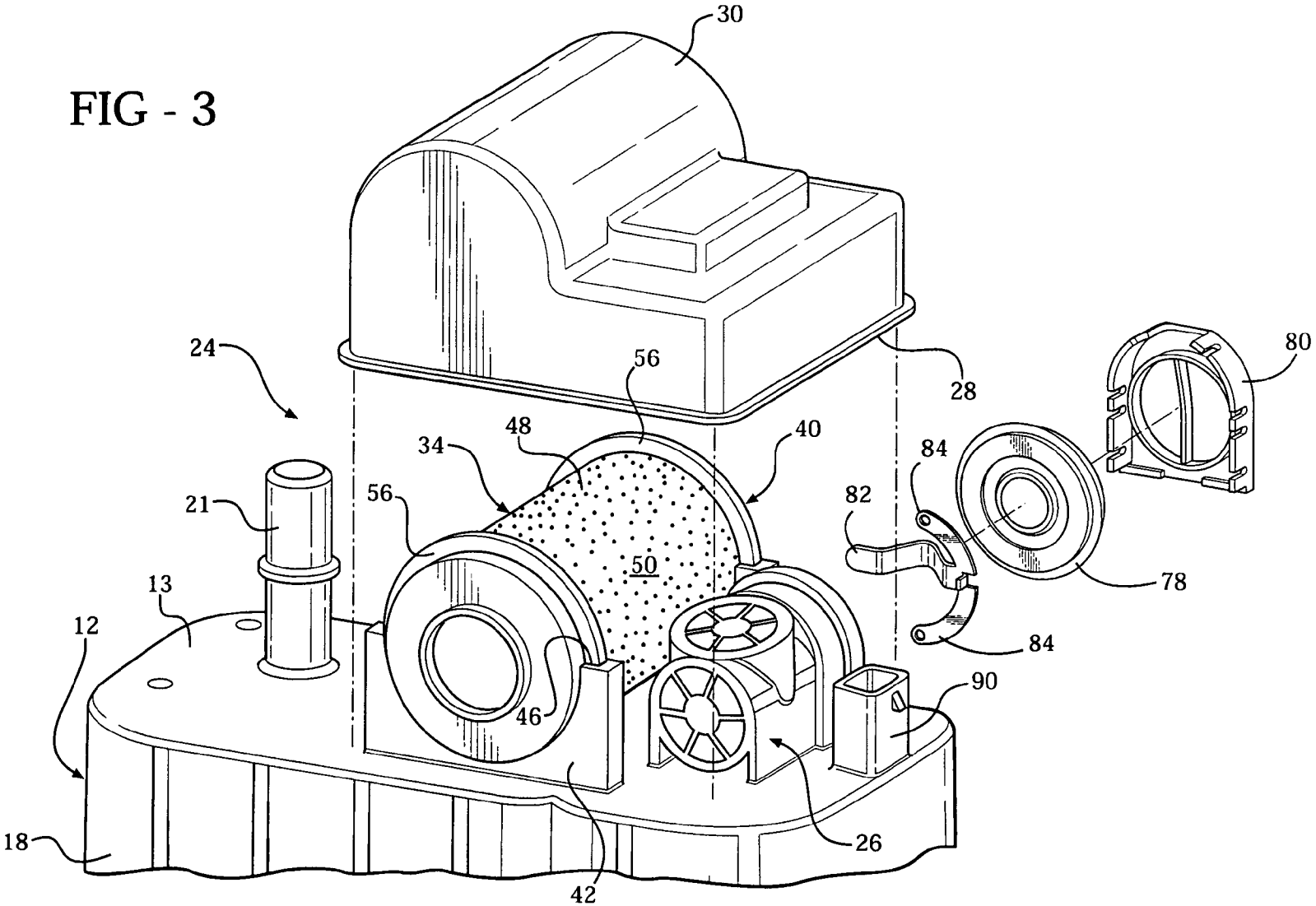
FIG. 3 is a partially exploded perspective view of the vapor canister having an integrated purge actuation monitoring system including an air filter assembly of the type illustrated in FIG. 2.

The vacuum actuated switch 64 includes a diaphragm 78 that is operatively supported by a retainer 80. The retainer 80 is mounted to the integrated valve body 26. As best shown in FIG. 3, the switch 64 further includes a flexible switch element 82 and a pair of terminals 84 supported by the integrated valve body 26. The switch element 82 is responsive to movement of the diaphragm 78 to connect the pair of terminals 84 in response to a predetermined negative pressure in the main flow passage 36 as will be described in greater detail below. To this end, the main flow passage 36 includes a small vacuum switch port 86 that provides fluid communication between a vacuum switch chamber 88 and the main flow passage 36. The integrated valve body 26 further includes a switch connector 90 (FIGS. 3-6 and 9) that provides electrical communication between the switch element 82 and the control unit 22. The operation of the vacuum actuated switch 64 as well as the first and second one-way umbrella valves 60, 62 will be described in greater detail below.

As noted above, evaporative emissions generated by the gasoline fuel may be collected in the vapor canister 12. Air that has been stripped of the volatile gasses may pass through the vapor canister 12 into the integrated evaporative emission canister purge actuation monitoring system 24 of the present invention. When the positive pressure of the evaporative emissions exceed a predetermined level, the valve element 68 of the first one-way umbrella valve 60 will move to open the vent port 76. This operative condition is illustrated in FIGS. 4 and 6. Air under the influence of this positive pressure will flow into the vent chamber 32, through the air filter 34 as indicated by the arrows in FIG. 6.

It is possible for the absorbent material, such as carbon, used in the vapor canister 12 to become saturated with volatile vapors. Accordingly, the vapor canister 12 must be periodically purged. This purging process must be controlled. Accordingly, during certain predetermined periods of engine operation, the engine control unit 22 signals the canister purge valve 20 to open thereby subjecting the vapor canister 12 to a vacuum generated at the engine via the intake manifold 16. When the purge valve 20 is opened, the evaporative emission canister purge actuation monitoring system 24 is also subject to the vacuum generated by the engine via the intake manifold 16. This causes fresh air to flow from the air filter 34, into the vent chamber 32 and past the valve element 72 of the second one-way umbrella valve 62. This operative condition is illustrated in FIG. 5 and by the arrows in FIG. 7. Fresh air then flows through the main flow passage 36, through the canister port 38 and into the vapor canister 12. This negative pressure causes volatile gasses trapped in the vapor canister 12 to be released and flow into the intake manifold of the engine. Purging the vapor canister 12 affects the air/fuel ratio entering the combustion chamber of the engine. Accordingly, this purging process must be monitored and controlled. The vacuum actuated switch 64 of the present invention serves this purpose.

To this end, the vacuum switch port 86 is calibrated such that the vacuum actuated switch 64 triggers once the vacuum generated during the vapor canister purge process has reached a predetermined level. More specifically, the vacuum switch port 86 communicates with both the main flow passage 36 and the vacuum switch chamber 88. The vacuum switch port 86 is subject to the purge vacuum that exists in the main flow passage 36 and is sized so that the diaphragm 78 moves the switch element 82 into contact with the pair of terminals 84 such that the switch 64 is triggered at a predetermined negative pressure. The switch 64 is connected in electrical communication with the engine control unit 22. When it triggers, the switch 64 sends a signal to the engine control unit 22. The engine control unit 22 uses this information to send a signal closing the canister purge valve 20. The vacuum switch port 86 is also calibrated in size to detect if any leaks are present in the evaporative emission system. If the switch 64 does not trigger in a predetermined period of time after the canister purge valve 20 has been opened, this indicates there exists a leak of a size greater than the vacuum switch port 86. Thus, the vapor canister 12 having an integrated evaporative emission canister purge actuation monitoring system 24 of the present invention serves a leak detection function for the vehicle evaporative emission system.

In this way, the vapor canister having an integrated canister purge actuation monitoring system of the present invention reduces the number of components needed to effectively monitor the evaporative emission system as well as the complicated onboard plumbing of the type required for systems known in the related art. The system senses the presence and duration of a purge vacuum that is imposed on the vapor canister when the canister purge valve is open and also senses the presence of a leak in the evaporative emission system, to the extent this condition occurs. The vapor canister having an integrated evaporative emission canister purge actuation monitoring system of the present invention is inexpensive to manufacture and easy to service in the field. Moreover, it has an improved response time and accurate repeatability when compared to known systems in the related art. Finally, the vapor canister having an integrated evaporative emission canister purge actuation monitoring system is designed so as to present a smaller, less bulky profile. Accordingly, it is easier to "package" the evaporative emission canister purge actuation monitoring system of the present invention in the engine compartment.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A vapor canister having an integrated evaporative emission canister purge actuation monitoring system for a motor vehicle having an engine, and at least one control unit, said vapor canister comprising:

a plurality of sidewalls defining a housing for said vapor canister, a valve body formed integrally on said housing of said vapor canister and a cover mounted to said valve body so as to define a vent chamber between the cover and the valve body;

said integrated valve body having a main flow passage and a canister port adapted to establish fluid communication between the vapor canister and said main flow passage;

an air filter assembly disposed adjacent said valve body on said housing and providing fluid communication between said main flow passage and the ambient air;

a first one-way umbrella valve mounted to said integrated valve body and responsive to a predetermined positive pressure in said main flow passage to control the flow of fluid from the vapor canister to the ambient air through said vent chamber and said air filter assembly; and a second one-way umbrella valve mounted to said integrated valve body and responsive to a predetermined negative pressure in said main flow passage to control the flow of ambient air through said air filter assembly and said vent chamber and through said main flow passage and said canister port.

2. A vapor canister as set forth in claim 1 wherein said air filter assembly includes a filter cartridge operatively supported between said housing of said vapor canister and said cover.

3. A vapor canister as set forth in claim 2 wherein said housing and said cover define a pair of opposed retainers that cooperate to mount said air filter cartridge to said housing.

4. A vapor canister as set forth in claim 3 wherein said air filter cartridge includes a cylindrical filter media defining an outer diameter, an inner diameter presenting a hollow passage and a pair of flanges disposed on either end of said air filter cartridge such that ambient air flows past said end flanges through said hollow passage and the filter media, past the outer diameter and into said vent chamber and air further flows from said vent chamber through the outer diameter of said filter media, past the inner diameter and into said hollow passage to the ambient air.

5. A vapor canister as set forth in claim 1 wherein said vapor canister further includes a vacuum actuated switch supported by said integrated valve body and in electrical communication with the control unit, said switch being responsive to a predetermined negative pressure in said main flow passage to send a signal indicative of the predetermined negative pressure to the control unit.

6. A vapor canister as set forth in claim 1 wherein said cover is operatively supported by said housing so as to define said vent chamber.

7. A vapor canister as set forth in claim 1 wherein said first one-way umbrella valve defines a first longitudinal axis and said second one-way umbrella valve defines a second longitudinal axis wherein said first and second longitudinal axes are disposed at an acute angle relative to one another.

8. A vapor canister as set forth in claim 7 wherein said main flow passage defines a longitudinal axis and a canister purge port, said second one-way umbrella valve mounted in said integrated valve body so as to control the flow of fluid through said canister purge port, said canister purge port defining an acute angle relative to a plane extending perpendicular said longitudinal axis of said main flow passage.

9. A vapor canister as set forth in claim 8 wherein said main flow passage defines a vent port, said first one-way umbrella valve mounted to said integrated valve body so as to control the flow of fluid through said vent port.

10. A vapor canister as set forth in claim 5 wherein said switch includes a diaphragm operatively supported by a retainer, said retainer mounted to said integrated valve body.

11. A vapor canister as set forth in claim 10 wherein said switch further includes a flexible switch element and a pair of terminals supported by said integrated valve body, said switch element responsive to movement of said diaphragm to connect said pair of terminals in response to a predetermined negative pressure in said main flow passage.

12. A vapor canister as set forth in claim 11 wherein said integrated valve body includes a switch connector providing electrical communication between said switch element and the control unit.

* * * * *